US008622114B2

(12) United States Patent
Kishikawa et al.

(10) Patent No.: US 8,622,114 B2
(45) Date of Patent: Jan. 7, 2014

(54) SEMIMOLTEN OR SEMI SOLID MOLDING METHOD AND MOLDING APPARATUS

(75) Inventors: Mitsuhiko Kishikawa, Sakai (JP); Masateru Yamamoto, Sakai (JP); Satoshi Yamamoto, Sakai (JP); Toshio Ohkado, Himeji (JP); Jun Iwane, Himeji (JP); Shuichi Shikai, Himeji (JP)

(73) Assignees: Daikin Industries, Ltd., Osaka (JP); Kogi Corporation, Hyogo (JP)

( * ) Notice: Subject to any disclaimer, the term of this patent is extended or adjusted under 35 U.S.C. 154(b) by 144 days.

(21) Appl. No.: 13/000,073

(22) PCT Filed: Jun. 23, 2009

(86) PCT No.: PCT/JP2009/002863

§ 371 (c)(1), (2), (4) Date: Dec. 20, 2010

(87) PCT Pub. No.: WO2009/157183

PCT Pub. Date: Dec. 30, 2009

(65) Prior Publication Data

US 2011/0100581 A1 May 5, 2011

(30) Foreign Application Priority Data

Jun. 27, 2008 (JP) ..... 2008-169599

(51) Int. Cl.

*B22D 23/00* (2006.01)
*B22D 17/04* (2006.01)
*B22D 19/00* (2006.01)

(52) U.S. Cl.

USPC ..... 164/133; 164/134; 164/312; 164/332

(58) Field of Classification Search

USPC ..... 164/133–135, 312, 332–335
See application file for complete search history.

(56) References Cited

U.S. PATENT DOCUMENTS

| | | | | |
|---|---|---|---|---|
| 4,586,560 | A * | 5/1986 | Ikeya et al. | 164/457 |
| 2002/0148592 | A1* | 10/2002 | Mori et al. | 164/137 |
| 2004/0211539 | A1* | 10/2004 | Hong | 164/113 |
| 2008/0176094 | A1 | 7/2008 | Czerwinski et al. | |

FOREIGN PATENT DOCUMENTS

| | | |
|---|---|---|
| CA | 2227828 | 7/1998 |
| CA | 2672193 | 7/2008 |
| JP | 1-162563 A | 6/1989 |
| JP | 3-86364 A | 4/1991 |

(Continued)

OTHER PUBLICATIONS

English machine translation of JP-05-050208.*
English translation of JP-05-050208.*
International Search Report of corresponding PCT Application No. PCT/JP2009/002863.

(Continued)

*Primary Examiner* — Kevin P Kerns
*Assistant Examiner* — Steven Ha
(74) *Attorney, Agent, or Firm* — Global IP Counselors

(57) ABSTRACT

A molded article includes a flat plate portion and a projected portion. A molding method includes filling a cavity with the semimolten or semisolid metal in plate thickness directions of the flat plate portion starting from a surface on an opposite side of the flat plate portion from the surface from which the projected portion projects. The cavity is a casting space of the molded article formed inside a forming mold. A molding apparatus for casting the molded article includes a forming mold having the cavity, and a separate insert or slide mold disposed between the cavity and a runner in order to form the runner in plate thickness directions of the flat plate portion starting from the other surface. The runner is used to fill the cavity.

10 Claims, 10 Drawing Sheets

(56) References Cited

FOREIGN PATENT DOCUMENTS

| | | | | |
|---|---|---|---|---|
| JP | 05050208 | A | * | 3/1993 |
| JP | 6-210426 | A | | 8/1994 |
| JP | 8-155626 | A | | 6/1996 |
| JP | 2005-36693 | A | | 2/2005 |

OTHER PUBLICATIONS

International Preliminary Report of corresponding PCT Application No. PCT/JP2009/002863.
Canadian Office Action of corresponding Canadian Application No. 2,727,967 dated May 29, 2012.

* cited by examiner

SEMIMOLTEN OR SEMI SOLID MOLDING METHOD AND MOLDING APPARATUS

CROSS-REFERENCE TO RELATED APPLICATIONS

This U.S. National stage application claims priority under 35 U.S.C. §119(a) to Japanese Patent Application No. 2008-169599, filed in Japan on Jun. 27, 2008, the entire contents of which are hereby incorporated herein by reference.

TECHNICAL FIELD

The present invention relates to a semimolten or semisolid molding method and a molding apparatus.

BACKGROUND ART

In the conventional art, a scroll member that has a scroll shaped portion, such as a fixed scroll or a movable scroll of a scroll compressor, is molded by a semimolten or semisolid molding method. For example, a scroll member is cast using a scroll casting apparatus, which is described in Japanese Laid-open Patent Application Publication No. H8-155626.

In such a scroll casting apparatus, when a cavity, which is a casting space inside the forming mold, is filled with molten metal, namely, when it is supplied with melt, the cavity is filled from the circumferential edge of an end plate, which is a flat plate portion of the scroll member (refer to FIG. 14).

SUMMARY

Technical Problem

However, in the semimolten or semisolid molding method using horizontal delivery, namely, when the cavity is filled with semimolten or semisolid cast iron, from the circumferential edge of the end plate, the shape of the pouring gate is widened and, consequently, the cross sectional length (and the circumferential length of the cross section) thereof is enlarged to secure the cross sectional area of the pouring gate needed to fill the scroll shaped portion of the scroll member. As a result, the semimolten or semisolid metal that fills the cavity during molding tends to cool, which can cause problems such as molding failures of the scroll member, for example, misruns in the thin scroll tip part, air inclusions, and cold shuts.

An object of the present invention is to provide a semimolten or semisolid molding method and a molding apparatus that can prevent misruns, air inclusions, and cold shuts during molding.

Solution to Problem

A semimolten or semisolid molding method according to a first aspect of the present invention is a semimolten or semisolid molding method for casting a molded article, which comprises a flat plate portion and a projected portion that projects from one surface of the flat plate portion, with a semimolten or semisolid metal. This molding method comprises the step of: filling a cavity, which is a casting space of the molded article formed inside a forming mold, with the semimolten or semisolid metal in plate thickness directions of the flat plate portion starting from an other surface on the opposite side of the flat plate portion to a one surface wherefrom the projected portion projects.

Here, because the cavity is filled with the semimolten or semisolid metal in the plate thickness directions of the flat plate portion starting from the other surface, which is on the opposite side of the flat plate portion to the one surface wherefrom the projected portion projects, the entire cavity can be smoothly filled with the semimolten or semisolid metal. As a result, it is possible to prevent misruns, air inclusions, and cold shuts.

A semimolten or semisolid molding method according to a second aspect of the present invention is the molding method according to the first aspect of the present invention, wherein the aspect ratio of a passageway cross section of a runner, which is a passageway for filling the cavity with the semimolten or semisolid metal, is less than 1:3.

Here, because the aspect ratio of the passageway cross section of the runner is less than 1:3, the cross sectional length of the passageway of the runner is reduced. Thereby, it is possible to reduce cooling of the semimolten or semisolid metal at the runner portion, which improves the fluidity of the melt. Consequently, the melt tends not to cool and misruns can be prevented, which improves yield.

A semimolten or semisolid molding method according to a third aspect of the present invention is the molding method according to the first or second aspects of the present invention, and comprises the steps of: inserting an insert or slide mold, which is separate from the forming mold, between the cavity and a runner, which is a passageway for filling the cavity with the semimolten or semisolid metal, from a direction different from the directions in which the runner extends; and subsequently filling the forming mold with the semimolten or semisolid metal.

Here, the insert or slide mold, which is separate from the forming mold, is inserted between the runner and the cavity from a direction different from the directions in which the runner extends, and the forming mold is subsequently filled with the semimolten or semisolid metal; therefore, it is possible not only to extend the runner to the center of the cavity but also to provide a scale trap mechanism along the runner and to effectively prevent the creation of a decarburized layer and the inclusion of oxide scaling. Moreover, after molding, the insert or slide mold can be easily detached from the forming mold without interfering with the runner.

A semimolten or semisolid molding method according to a fourth aspect of the present invention is the molding method according to the first through third aspects of the present invention, wherein the molded article is a scroll member that comprises an end plate, which is the flat plate portion, and a scroll shaped portion, which is the projected portion. The scroll member further comprises a columnar boss that projects toward the other surface on the opposite side of the end plate to the one surface wherefrom the scroll shaped portion projects. The cavity of the forming mold of the scroll member is filled with the semimolten or semisolid metal through a runner, which is a passageway for filling the cavity with the semimolten or semisolid metal, from the boss portion.

Here, filling the cavity starting from the boss of the scroll member makes it possible to smoothly fill the entire cavity with the semimolten or semisolid metal, and thereby to more effectively prevent misruns.

A semimolten or semisolid molding apparatus according to a fifth aspect of the present invention is a semimolten or semisolid molding apparatus for casting a molded article, which comprises a flat plate portion and a projected portion that projects from one surface of the flat plate portion, with a semimolten or semisolid metal. The molding apparatus comprises: a forming mold wherein a cavity, which is a casting space of the molded article, is formed; and an insert or slide mold. The insert or slide mold is disposed between the cavity and a runner in order to form the runner, which is a passageway for filling the cavity with the semimolten or semisolid metal in plate thickness directions of the flat plate portion starting from an other surface on the opposite side of the flat plate portion to a one surface wherefrom the projected portion projects. The insert or slide mold is separate from the forming mold and is inserted from a direction different from the directions in which the runner extends.

Here, the molding apparatus comprises an insert or slide mold, which is separate from the forming mold, that is disposed between the cavity and a runner in order to form the runner, which is a passageway for filling the cavity with the semimolten or semisolid metal in plate thickness directions of the flat plate portion starting from an other surface on the opposite side of the flat plate portion to a one surface wherefrom the projected portion projects; wherein, the insert or slide mold is inserted from a direction different from the directions in which the runner extends; therefore, the runner can be extended to the center of the cavity, which effectively prevents the creation of a decarburized layer and the inclusion of oxide scaling.

Advantageous Effects of Invention

According to the first aspect of the present invention, the entire cavity can be smoothly filled with the semimolten or semisolid metal. As a result, it is possible to prevent misruns, air inclusions, and cold shuts.

According to the second aspect of the present invention, it is possible to reduce cooling of the semimolten or semisolid metal at the runner portion, which improves the fluidity of the melt. Consequently, the melt tends not to cool and misruns can be prevented, which improves yield.

According to the third aspect of the present invention, it is possible to extend the runner to the center of the cavity and to provide a scale trap mechanism, which effectively prevents the creation of a decarburized layer and the inclusion of oxide scaling. Moreover, after molding, the insert or slide mold can be easily detached from the forming mold without interfering with the runner.

According to the fourth aspect of the present invention, the entire cavity can be smoothly filled with the semimolten or semisolid metal, and thereby misruns can be prevented more effectively.

According to a fifth aspect of the present invention, the runner can be extended to the center of the cavity and a scale trap structure can be provided, which effectively prevents the creation of a decarburized layer and the inclusion of oxide scaling.

DESCRIPTION OF EMBODIMENTS

Next, an embodiment of the semimolten or semisolid molding method and the molding apparatus of the present invention will be explained, referencing the drawings.

<Configuration of a Semimolten or Semisolid Molding Apparatus 1>

Figure 1:
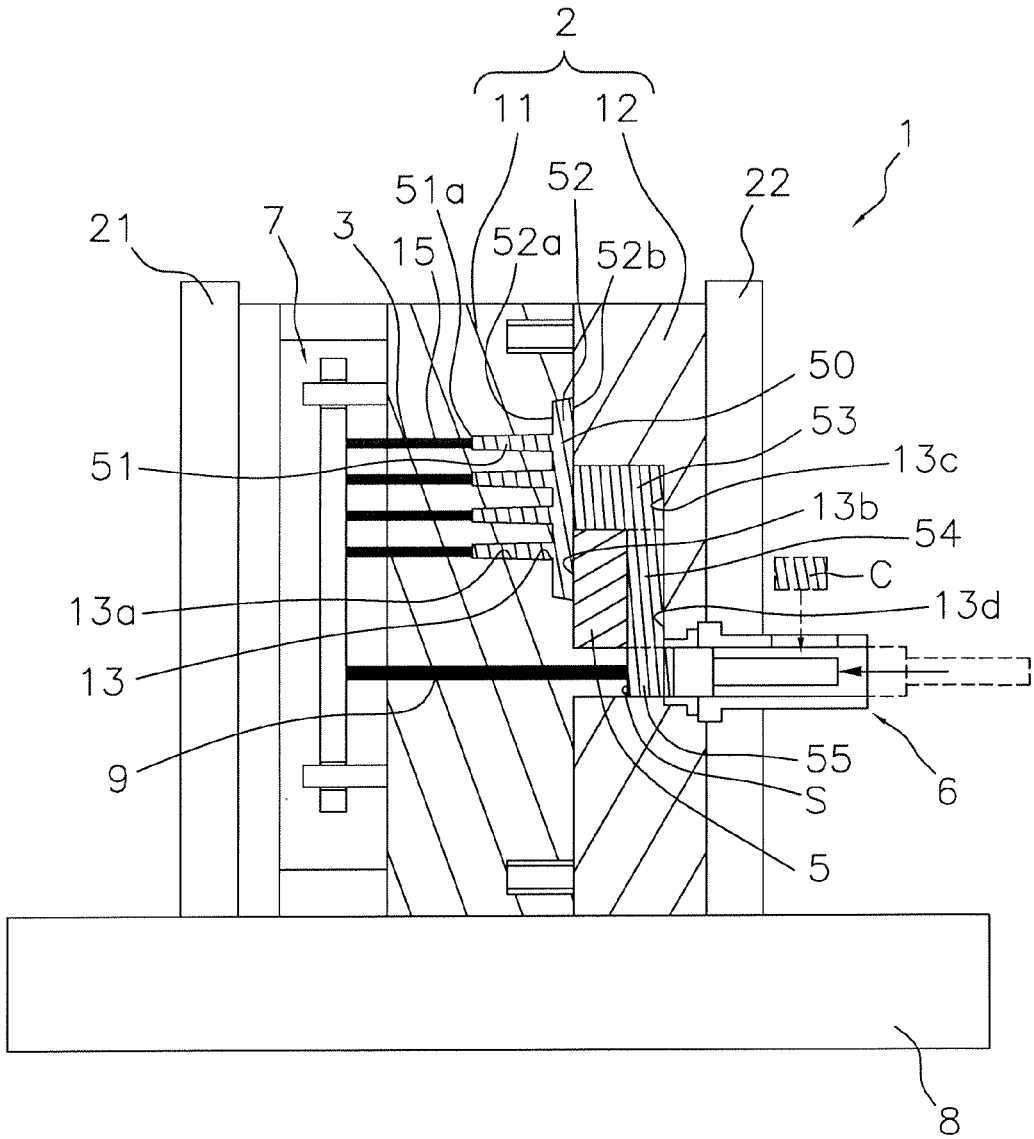
FIG. 1 is a block diagram of a semimolten or semisolid molding apparatus according to an embodiment of the present invention.

A semimolten or semisolid molding apparatus 1 (hereinbelow, called a molding apparatus 1) shown in FIG. 1 is a molding apparatus for molding a movable scroll of a scroll compressor, namely, a scroll member 50 that comprises: a scroll shaped portion 51; a plate shaped end plate 52, which is formed on a base side of the scroll shaped portion 51; and a columnar boss 53, which is formed on the opposite side of the end plate 52 to the scroll shaped portion 51.

The molding apparatus 1 comprises a scroll member forming mold 2 (hereinbelow, called a forming mold 2), scroll ejector pins 3, an insert or slide mold 5, a material filling mechanism 6, an ejector pin drive mechanism 7, and a base frame 8.

In the molding apparatus 1, the material filling mechanism 6 fills, while applying pressure, the interior of the forming mold 2 with a semimolten or semisolid metal material C, which is a ferrous semimolten or semisolid metal material, and thereby the scroll member 50 can be molded.

Figure 11:
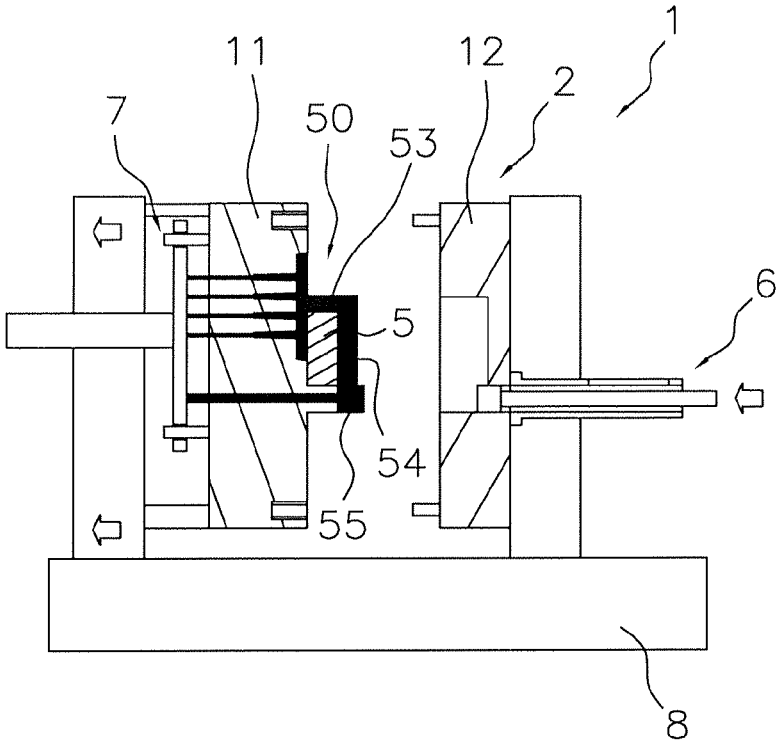
FIG. 11 is a mold opening process diagram in a series of process diagrams of the semimolten or semisolid molding method that uses the molding apparatus in FIG. 1.

After the scroll member 50 has been molded, a driving means (not shown) pulls one of the molds that constitute the forming mold 2, namely, a movable mold 11, along the base frame 8 away from the other mold, namely, a fixed mold 12 (refer to FIG. 11). The scroll member 50 can then be removed from the interior of the movable mold 11 by the ejector pin drive mechanism 7 pushing the scroll ejector pins 3 and a supplementary ejector pin 9 into the movable mold 11 (refer to FIG. 12).

The forming mold 2, the scroll ejector pins 3, and the insert or slide mold 5 are described in greater detail in separate sections below.

<Configuration of the Scroll Member Forming Mold 2 and the Insert or Slide Mold 5>

As shown in FIG. 1, the forming mold 2 comprises a movable mold 11, which reciprocatively moves along the base frame 8, and the fixed mold 12, which is fixed on the base frame 8.

In addition, the molding apparatus 1 further comprises the insert or slide mold 5 in order to form a runner 54, or passageway, for filling a casting space—namely, a cavity 13, which has the shape of the scroll member 50 that is formed when the movable mold 11 and the fixed mold 12 are joined—with the semimolten or semisolid metal material.

The insert or slide mold 5, which is a separate member from the movable mold 11 and the fixed mold 12 of the forming mold 2, is disposed between the cavity 13 and the runner 54 and is detachably attached to the fixed mold 12.

The insert or slide mold 5 is disposed between the cavity 13 and the runner 54 in order to form the runner 54, which is a passageway for filling the cavity 13 with the semimolten or semisolid metal in the plate thickness directions of the end plate 52 starting from a second surface 52*b*; note that the second surface 52*b* is on the opposite side of the end plate 52, which is a flat plate portion, to a first surface 52*a* wherefrom the scroll shaped portion 51, which is a projected portion of the end plate 52, projects.

For example, the slide mold 5 can move reciprocatively along directions different from those in which the runner 54 extends, namely, in the present embodiment, the directions perpendicular to the paper plane in FIG. 1 and orthogonal to the directions in which the runner 54 extends; thereby, the slide mold 5 is inserted into and removed from the interior of the fixed mold 12. In addition, the insert 5 may be inserted into the fixed mold 12 either along the directions perpendicular to the paper plane of FIG. 1 and orthogonal to the directions in which the runner 54 extends or from the left in FIG. 1.

In addition, a bent part of the runner 54 can be provided with a scale trap in order to eliminate any decarburized layer, oxide scaling, or the like. For example, as shown in FIG. 1, a scale trap S is provided such that it projects linearly or arcuately from a material residuary part 55, but the present invention is not limited thereto; for example, the position and the shape of the scale trap may be modified in a variety of ways.

As shown in FIG. 1, within the cavity 13 for forming the scroll member 50, the movable mold 11 has a scroll shaped groove 13*a*, which is for forming the scroll shaped portion 51, and a flat plate shaped groove 13*b*, which is for forming the end plate 52.

As shown in FIG. 1, within the cavity 13 for forming the scroll member 50, the fixed mold 12 has a columnar groove 13*c* for forming the columnar boss 53. Furthermore, the fixed mold 12 has a runner groove 13*d* for forming the runner 54.

The movable mold 11 is fixed to a movable platen 21 and moves reciprocatively together with the movable platen 21 on the base frame 8. The fixed mold 12 is fixed to a fixed platen 22 and is stationary on the stage 8.

<Configuration of the Scroll Ejector Pins 3>

The scroll ejector pins 3 shown in FIG. 1 are attached to the ejector pin drive mechanism 7 such that they pass through through holes 15 formed in the movable mold 11 and can appear and disappear to the tip of the scroll shaped groove 13*a* of the cavity 13.

After the scroll member 50 has been molded, the scroll ejector pins 3 can eject the scroll member 50 from the movable mold 11 by pressing against a tip 51*a* of the scroll shaped portion 51 of the scroll member 50.

<Overview of the Semimolten or Semisolid Molding Method>

In the semimolten or semisolid molding method of the present embodiment, the cavity 13, which is the casting space of the scroll member 50—namely, the molded article formed inside the forming mold 2—is filled with the semimolten or semisolid metal in the plate thickness directions of the end plate 52 starting from the second surface 52*b*, which is on the opposite side of the end plate 52 to the first surface 52*a* wherefrom the scroll shaped portion 51 projects. Consequently, because the melt is supplied not from the circumferential edge of the end plate 52 but rather from the rear side surface, whereon the scroll shaped portion 51 is not formed, namely, the second surface 52*b*, it is possible to smoothly fill the entire cavity 13 with the semimolten or semisolid metal and, as a result, to prevent misruns, air inclusions, or cold shuts.

In addition, the scroll member 50 molded in the present embodiment is a movable scroll that comprises the columnar boss 53 that projects from the second surface 52*b*, which is on the opposite side of the end plate 52 to the first surface 52*a* wherefrom the scroll shaped portion 51 projects. Accordingly, the semimolten or semisolid metal fills the cavity 13 of the forming mold 2 of the scroll member 50 from the portion of the boss 53 positioned at the center of the end plate 52 and through the runner 54, which is a passageway for filling the cavity 13 with the semimolten or semisolid metal.

Thus, filling the cavity 13 starting from the boss 53 of the scroll member 50 makes it possible to smoothly fill the entire cavity 13 (particularly the entire flat plate shaped groove 13*b* wherein the end plate 52 is formed) with the semimolten or semisolid metal.

Figure 13:
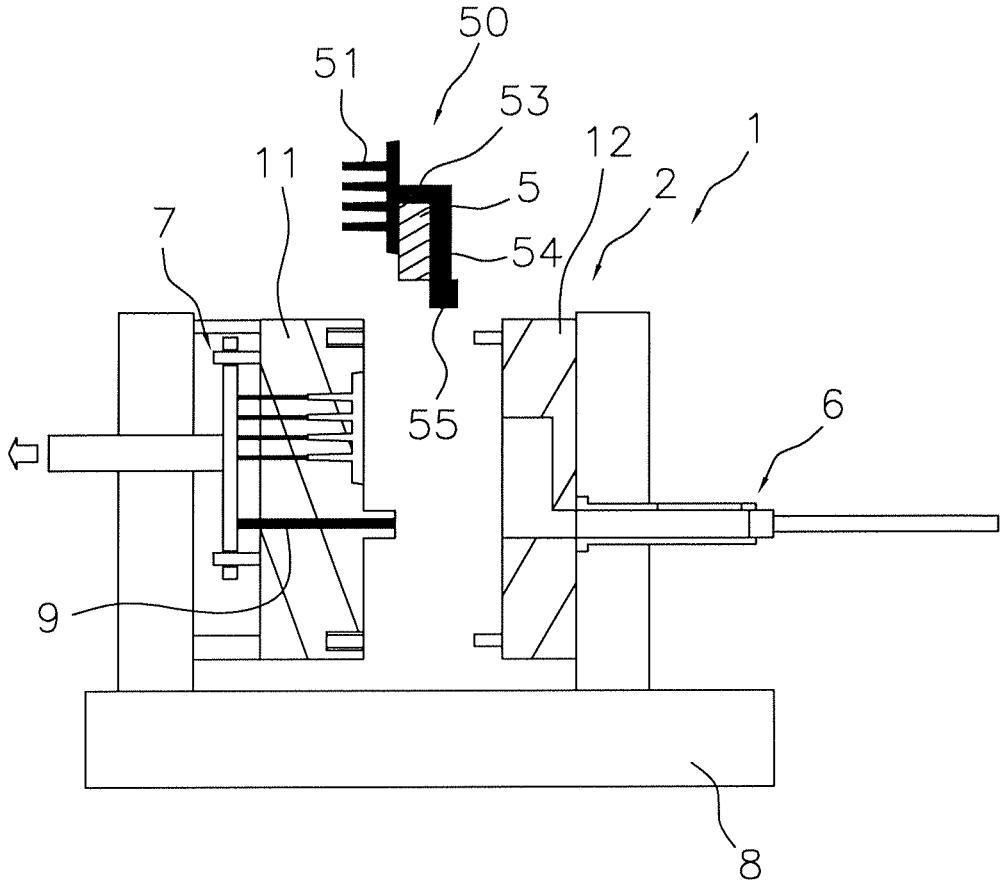
FIG. 13 is a molded article removing process diagram in a series of process diagrams of the semimolten or semisolid molding method that uses the molding apparatus in FIG. 1.

Furthermore, after molding, one end of the runner 54 is connected to the boss 53, and the other end of the runner 54 is connected to the material residuary part 55 on the material filling mechanism 6 side. Accordingly, after molding, the scroll member 50 is removed from the forming mold 2 as shown in FIG. 13, and the runner 54 and the material residuary part 55 are then cut off.

Furthermore, in order to eliminate any decarburized layer, oxide scaling, or the like on the surface of the semimolten or semisolid metal material C immediately after the semimolten or semisolid metal material C comes out of the material filling mechanism 6, the material filling mechanism 6 is disposed spaced apart from, but not immediately behind, the boss 53 by a distance commensurate with a dimension of the runner 54. Thereby, because the scale eliminated from the surface of the semimolten or semisolid metal material C principally accumulates in the scale trap (not shown), which is configured along the material residuary part 55, the runner 54, or the like, contamination of the scroll member 50 by impurities is reduced.

Figure 2:
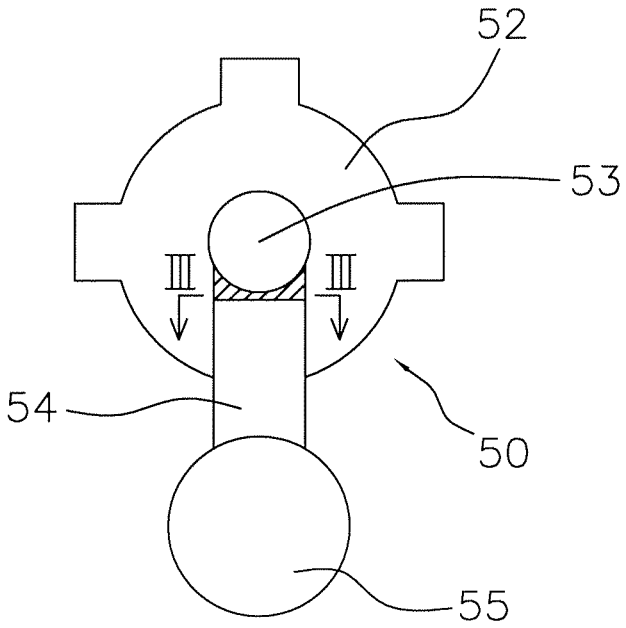
FIG. 2 is a plan view of a scroll member, a runner, and a semimolten or semisolid metal material residuary part molded by the semimolten or semisolid molding apparatus in FIG. 1.
Figure 3:
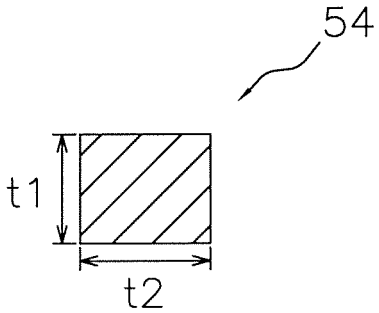
FIG. 3 is a cross sectional view taken along the line of the runner in FIG. 2.

In addition, as shown in FIGS. 1-3, the aspect ratio of the passageway cross section of the runner 54 (i.e., the ratio of a longitudinal length t1 to a transverse length t2 of the passageway cross section of the runner 54 shown in FIG. 3), which is a passageway for filling the cavity 13 with the semimolten or semisolid metal, is t1:t2<1:3 (specifically, for example, t1:t2=1:2.99-1:1). Furthermore, for the sake of convenience in the explanation, the longitudinal length t1 and the transverse length t2 of the passageway cross section of the runner 54 are defined only in terms of being vertical and horizontal, and the filling of the semimolten or semisolid metal is not particularly affected even if the vertical and horizontal directions are switched.

Because the aspect ratio of the passageway cross section of the runner 54 is less than 1:3, the passageway of the runner 54 is not flat but rather has, for example, a somewhat square or circular cross sectional shape. Thereby, the reduced cross sectional length of the passageway of the runner 54 (as well as the circumferential length of the pouring gate cross section) reduces cooling of the semimolten or semisolid metal at the runner 54 portion, which improves the fluidity of the melt.

Furthermore, there is a relation expressed as equivalent hydraulic diameter=4A/L, wherein A is the cross sectional area of the passageway and L is the cross sectional length (or the circumferential length of the pouring gate cross section). Here, the equivalent hydraulic diameter refers to the diameter of a tube of equivalent cross section.

For example, in a concrete example wherein the aspect ratio of the passageway cross section of the runner 54 is less than 1:3, if the passageway cross section of the runner 54 is a square cross section of 30×30 mm (i.e., with an aspect ratio of 1:1), then an equivalent hydraulic diameter D1 is calculated by D1=(4A/L)=(4×30×30)/(4×30)=30 mm, and therefore a passageway equivalent to a passageway with a circular cross section of 30 mm can be secured.

However, in a concrete example wherein the aspect ratio of the passageway cross section of a runner 154 is 1:10-1:7, as shown in a comparative example discussed below (refer to FIG. 16), if the passageway cross section of the runner 154 is a flat rectangular cross section of 10×90 mm (i.e., with an aspect ratio of 1:9), then an equivalent hydraulic diameter D2 is calculated by D2=(4A/L)=(4×10×90)/(2×(10+90))=18 mm, and therefore the passageway is extremely narrow even though the cross sectional area (i.e., 900 $mm^2$) is the same as that of the abovementioned square cross section of 30×30 mm.

Figure 4:
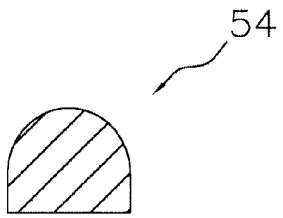
FIG. 4 is a cross sectional view of a semicircular cross section of the runner according to a modified example of the embodiment of the present invention.
Figure 5:
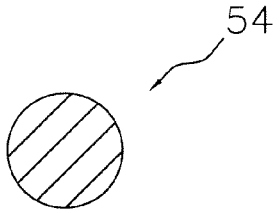
FIG. 5 is a cross sectional view of a circular cross section of the runner according to another modified example of the embodiment of the present invention.

The aspect ratio of the passageway cross section of the runner 54 should be less than 1:3, and thereby the runner 54 is formed with an easy-to-design rectangular cross section, as shown representatively in FIG. 3. In addition, various cross sectional shapes can be adopted as long as the aspect ratio is less than 1:3; for example, as modified examples of the present invention, a semidomed mold cross section of the type shown in FIG. 4, a circular cross section as shown in FIG. 5, or an elliptical cross section (not shown) may be adopted. In these cases, too, the cross sectional length of the passageway of the runner 54 can be shortened, and therefore the melt tends not to cool and yield improves.

In addition, in the present embodiment, the insert or slide mold 5, which is separate from the forming mold 2, is inserted between the runner 54 and the cavity 13 from a direction different from the directions in which the runner 54 extends, and the forming mold 2 is subsequently filled with the semimolten or semisolid metal. Thus, the insertion of the insert or slide mold 5, which is separate from the forming mold 2, into the fixed mold 12 makes it possible to extend the runner 54 to the center of the cavity 13 (in particular, to the end plate 52 portion), and thereby to effectively prevent misruns, air inclusions, or cold shuts.

<Procedure of the Semimolten or Semisolid Molding Method>

Next, the semimolten or semisolid molding method, which uses the molding apparatus 1 of the present embodiment, will be explained, referencing FIGS. 6-13.

Figure 6:
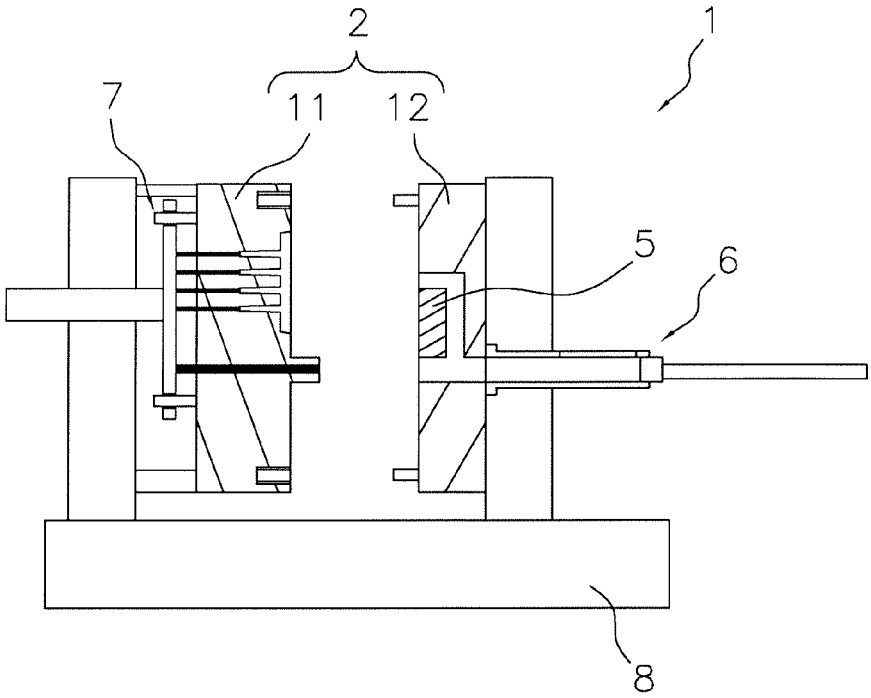
FIG. 6 is an initial state diagram in a series of process diagrams of the semimolten or semisolid molding method that uses the molding apparatus in FIG. 1.
Figure 7:
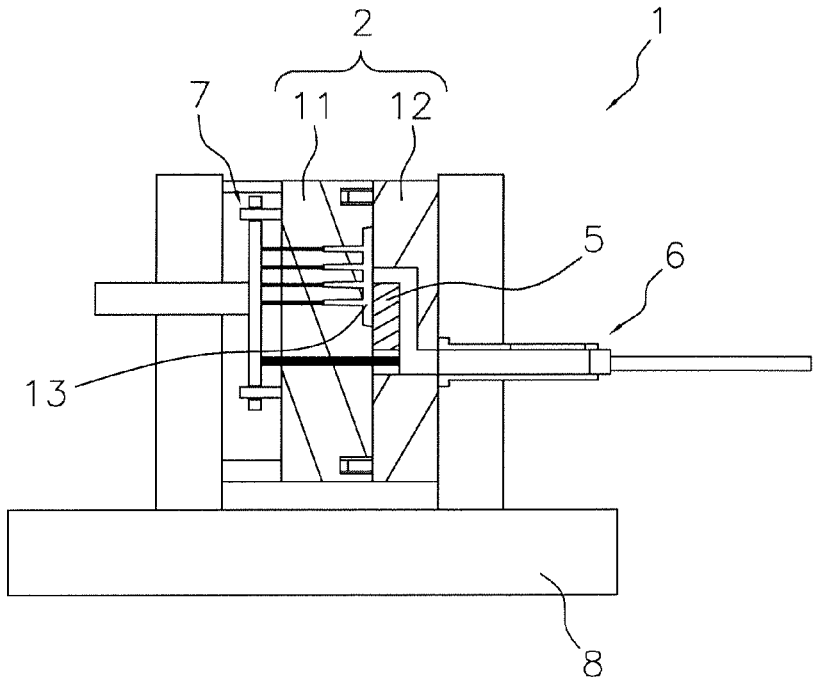
FIG. 7 is a mold clamping process diagram in a series of process diagrams of the semimolten or semisolid molding method that uses the molding apparatus in FIG. 1.

First, starting from an initial state shown in FIG. 6, the movable mold 11 is moved along the base frame 8 as shown in FIG. 7, which couples the movable mold 11 and the fixed mold 12 to form the cavity 13 (i.e., in a mold clamping process).

Figure 8:
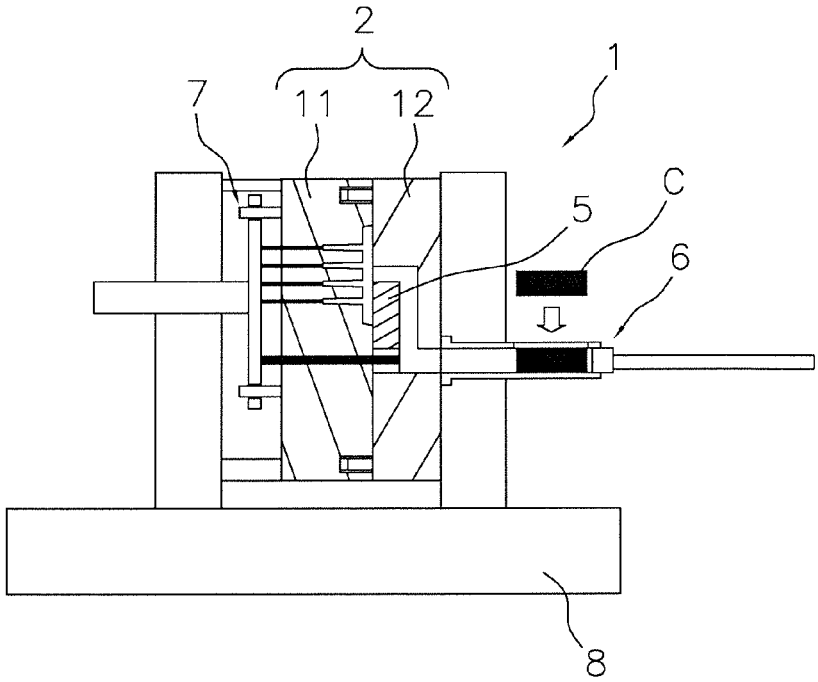
FIG. 8 is a material pouring process diagram in a series of process diagrams of the semimolten or semisolid molding method that uses the molding apparatus in FIG. 1.

Subsequently, as shown in FIG. 8, the semimolten or semisolid metal material C is loaded into the material filling mechanism 6 (i.e., in a material pouring process).

Figure 9:
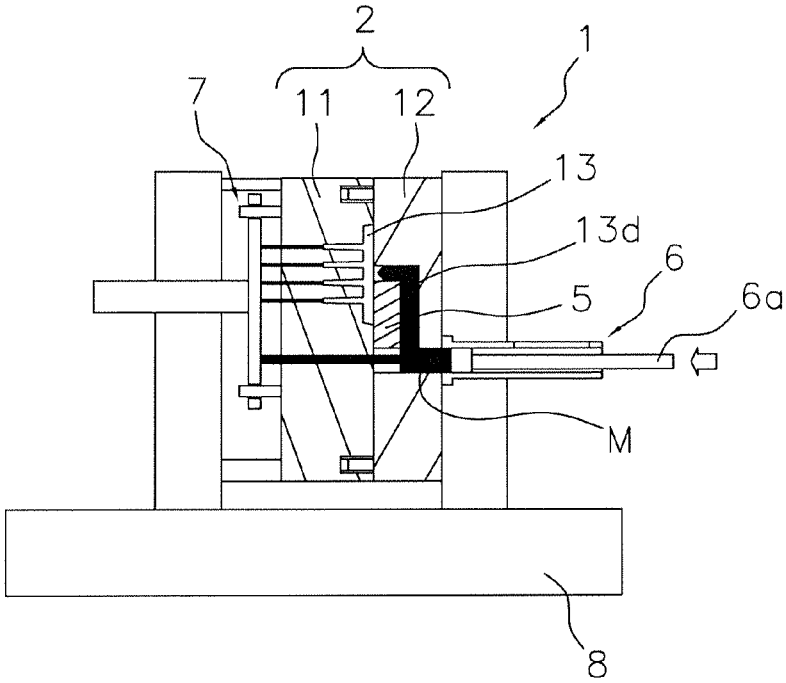
FIG. 9 is a filling process diagram in a series of process diagrams of the semimolten or semisolid molding method that uses the molding apparatus in FIG. 1.

Next, as shown in FIG. 9, a plunger 6*a* of the material filling mechanism 6 is moved by hydraulic pressure or pneumatic pressure, which applies pressure to the semimolten or semisolid metal material C and fills the interior of the forming mold 2 with the semimolten or semisolid metal material C (i.e., in a filling process). At this time, a semimolten or semisolid metal M, which is in the process of filling the cavity 13, passes through the runner groove 13*d* and fills the cavity 13. Because the runner groove 13*d* has a rectangular, nearly square cross section, as mentioned above, the semimolten or semisolid metal M can reach the cavity 13 without tending to cool inside the runner groove 13*d*.

Figure 10:
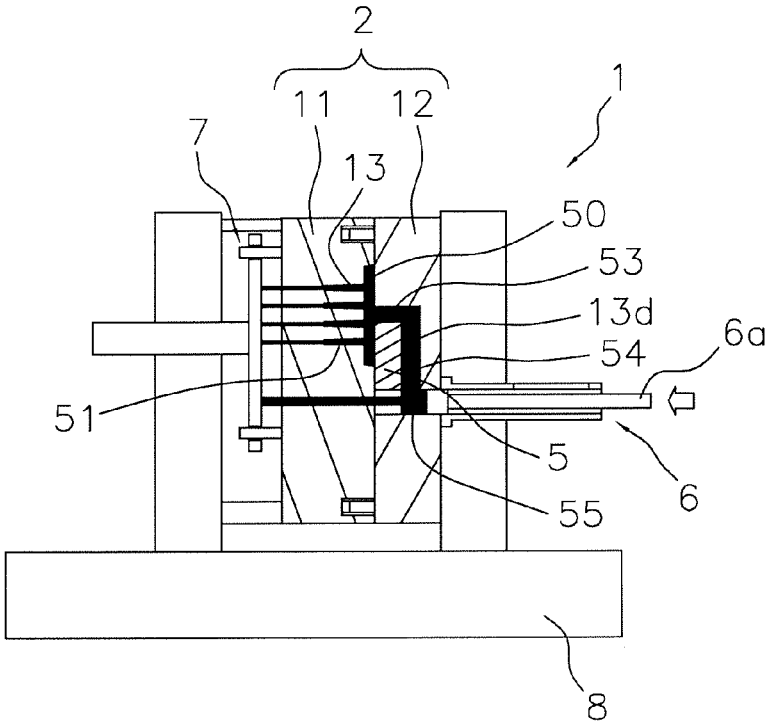
FIG. 10 is a filling completed state diagram in a series of process diagrams of the semimolten or semisolid molding method that uses the molding apparatus in FIG. 1.

Subsequently, as shown in FIG. 10, when the filling of the entire cavity 13 with the semimolten or semisolid metal M has completed and the semimolten or semisolid metal M has subsequently cooled and solidified, the molded scroll member 50 is molded inside the cavity 13 (which marks the completion of filling). The molded scroll member 50 is connected to the runner 54, which is formed inside the runner groove 13*d*, and the material residuary part 55.

Next, as shown in FIG. 11, the movable mold 11 is moved along the base frame 8, which separates the movable mold 11 from the fixed mold 12 and opens the forming mold 2 (i.e., in a mold opening process). At this time, the insert or slide mold 5 is in a state wherein it is interposed between the scroll member 50 and the runner 54.

Figure 12:
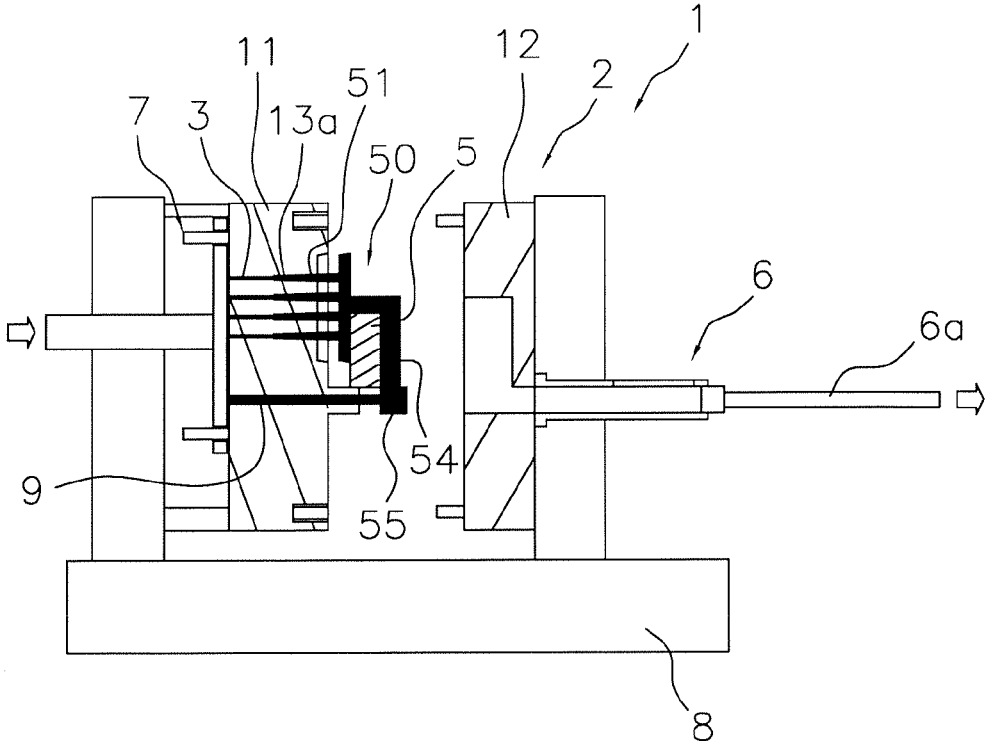
FIG. 12 is an ejecting process diagram in a series of process diagrams of the semimolten or semisolid molding method that uses the molding apparatus in FIG. 1.

Next, as shown in FIG. 12, if an insert is used as the insert or slide mold 5, then driving the ejector pin drive mechanism 7 causes the scroll ejector pins 3 to project into the inside of the scroll shaped groove 13*a* of the movable mold 11, and thereby the scroll ejector pins 3 press against the scroll shaped portion 51 of the scroll member 50. In addition, driving the ejector pin drive mechanism 7 also causes the supplementary ejector pin 9 to project from the movable mold 11 and press against the material residuary part 55. Thereby, the molded scroll member 50, the runner 54, the material residuary part 55, and the insert 5, which have become integrated, can be ejected from the interior of the movable mold 11 (i.e., in an ejecting process). In addition, simultaneous with the ejecting process, the plunger 6*a* returns to its initial position.

However, if a slide mold is used as the insert or slide mold 5, then, prior to driving the ejector pin drive mechanism 7, the slide mold 5 is opened using a slide mold drive mechanism (not shown) or the like, which is provided to, for example, the movable mold 11, to divide the slide mold 5 in two and move the two parts away from one another along the directions perpendicular to the paper plane in FIG. 12. Subsequently, the ejector pin drive mechanism 7 can be driven to eject only the molded scroll member 50, the runner 54, and the material residuary part 55, which have become integrated, from the interior of the movable mold 11.

Next, as shown in FIG. 13, the molded scroll member 50, the runner 54, the material residuary part 55, and the insert 5, which have become integrated, are removed from the interior of the forming mold 2 (i.e., in a molded article removing process). At this time, the scroll ejector pins 3 and the supplementary ejector pin 9 return to the initial state shown in FIG. 6.

The molded scroll member 50 is cut at the boundary portion between the runner 54 and the boss 53 and separated from the runner 54 and the material residuary part 55. In addition, the insert 5 interposed between the scroll member 50 and the runner 54 is separated therewith.

With regard to the final finishing of the scroll member 50, the scroll member 50 can be surface finished to the dimensions and surface roughness required of the finished article using end milling, wheel mounted grinding, aero lapping, and the like.

COMPARATIVE EXAMPLE

Figure 14:
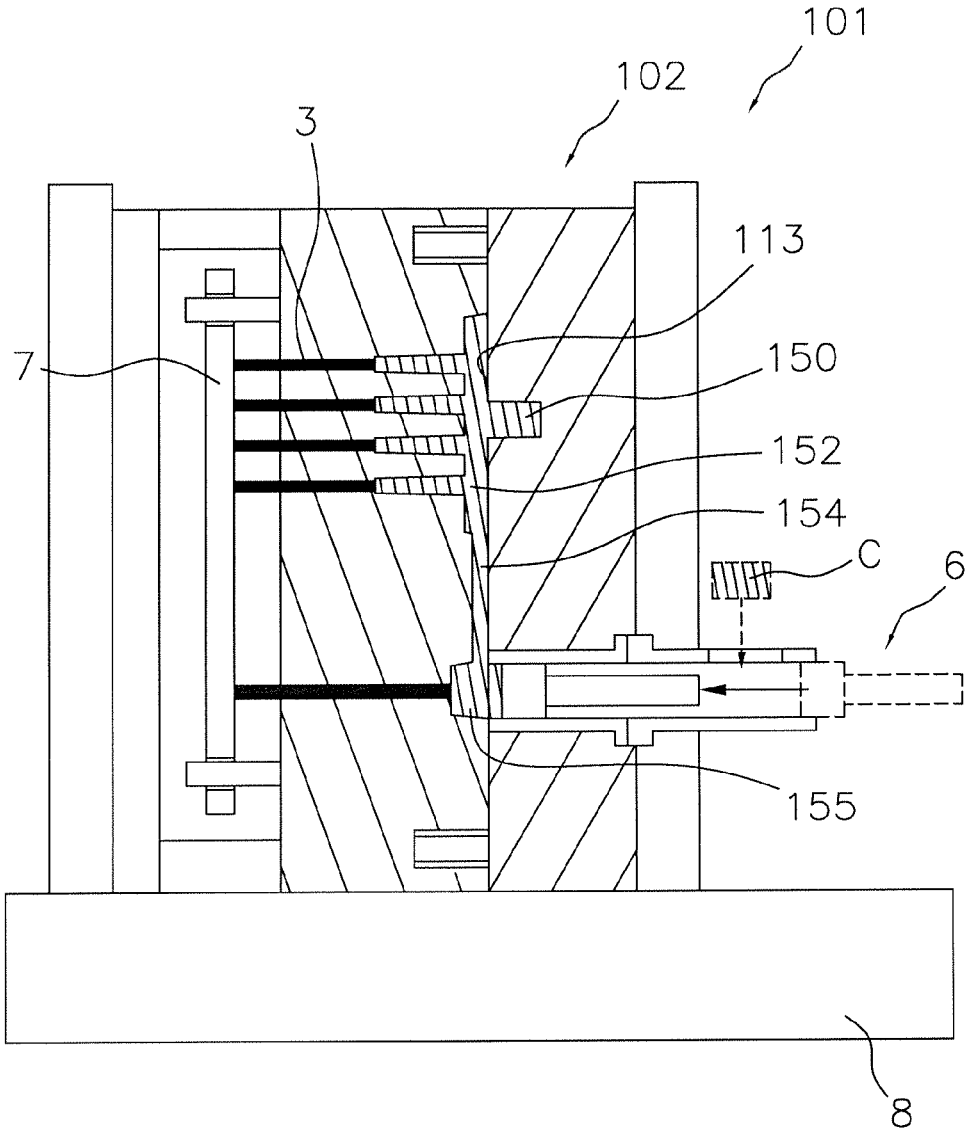
(Prior Art) FIG. 14
FIG. 14 is a block diagram of a scroll casting apparatus according to a comparative example.

Here, as a comparative example shown in FIG. 14, in a scroll casting apparatus 101, which is recited in the above-mentioned Patent Document 1 and used in the conventional art, when a cavity 113, which is a casting space inside a forming mold 102, is filled with molten metal, namely, when it is supplied with melt, the cavity 113 is filled from a circumferential edge of an end plate 152, which is a flat plate portion of a scroll member 150 (refer to FIG. 14).

In a molding method wherein the cavity 113 is filled with semimolten or semisolid cast iron in the scroll casting apparatus 101 according to the comparative example, a so-called horizontal delivery method is adopted wherein the cavity 113 is filled with the melt starting from the circumferential edge of the end plate 152.

Furthermore, as in the molding apparatus 1 shown in FIG. 1, the scroll casting apparatus 101 according to the comparative example likewise comprises the scroll ejector pins 3, the material filling mechanism 6, and the base frame 8.

Figure 15:
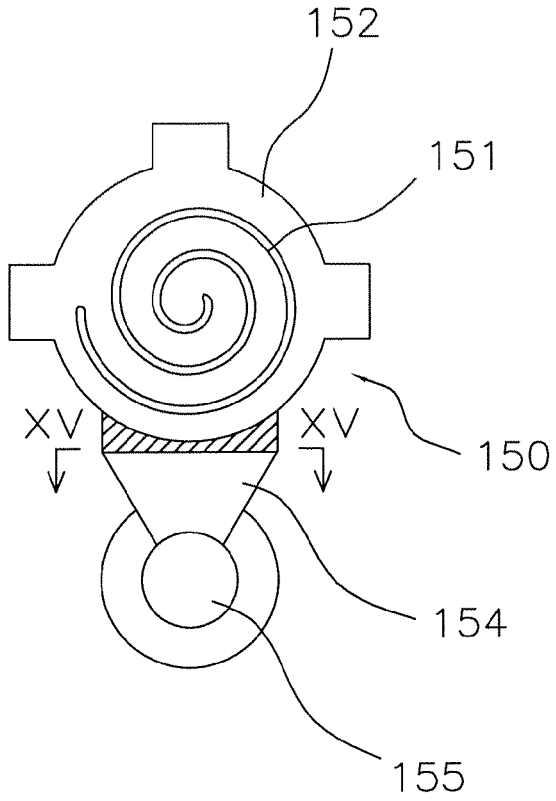
(Prior Art) FIG. 15
FIG. 15 is a plan view of a scroll member, a runner, and a semimolten or semisolid metal material residuary part molded by the scroll casting apparatus shown in FIG. 14.
Figure 16:
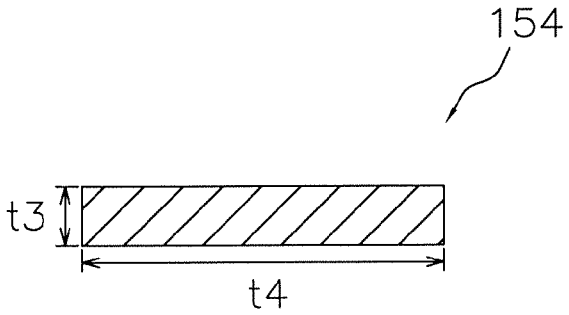
(Prior Art) FIG. 16
FIG. 16 is a cross sectional view taken along the XV-XV line of the runner in FIG. 15.

In this comparative example, as shown in FIGS. 15-16, the shape of the pouring gate of the passageway of the runner 154 is widened in order to secure a pouring gate cross sectional area needed to fill the scroll shaped portion 151 of the scroll member 150. Furthermore, a symbol 155 is a material residuary part on the material filling mechanism 6 side. Consequently, the cross sectional length of the passageway of the runner 154 (as well as the circumferential length of the pouring gate cross section) is enlarged. In other words, as shown in FIG. 16, the aspect ratio of the passageway cross section of the runner 154 is t3:t4=1:10-1:7.

As a result, the semimolten or semisolid metal, with which the cavity 113 is filled during molding, tends to cool inside the flat runner 154, whose cross sectional length is large. Consequently, as shown in FIG. 17, there is a risk that molding failures will occur in the scroll member 150, for example, a misrun at the tip part of the thin scroll shaped portion 151.

Figure 17:
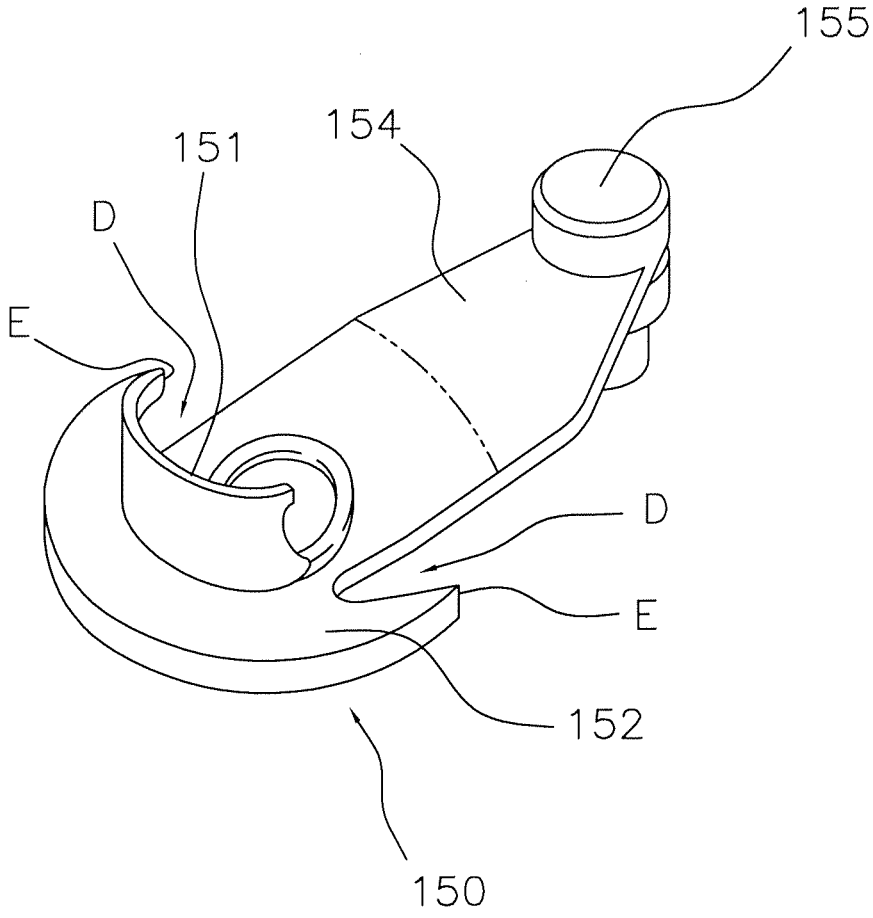
(Prior Art) FIG. 17
FIG. 17 is an oblique view of the scroll member, the runner, and the semimolten or semisolid metal material residuary part in the state wherein a misrun was molded by the scroll casting apparatus in FIG. 14.

Moreover, as shown in FIG. 17, the insufficient filling of the interior of the cavity 113 (particularly the end plate 52 portion) with the molten metal creates the risk of air inclusions in a portion D inside the cavity 113. In addition, there is a risk that a defective article will be produced owing to the enfolding of the molten metal from two directions at the end plate 52 portion, which causes the molten metal flows to overlap at a tip portion E and create seams, namely, cold shuts.

Moreover, because the shape of the runner 154 is also wide, the scroll member 150 cannot be finished with a lathe after the runner 154 is cut from the molded scroll member 150, and therefore machining wherein a cutting tool, such as an end mill, is used to mill along the outer circumference of the discoidal end plate 152 is further required, which in turn increases manufacturing costs.

<Features>

(1)

In the present embodiment, the cavity 13, which is a casting space of the scroll member 50 that is the molded article formed inside the forming mold 2, is filled with the semimolten or semisolid metal in the plate thickness directions of the end plate 52 starting from the second surface 52*b*; note that the second surface 52*b* is on the opposite side of the end plate 52 to the first surface 52*a* wherefrom the scroll shaped portion 51 projects. Consequently, because the melt is supplied not from the circumferential edge of the end plate 52 but rather from the rear side surface, namely, the second surface 52*b*, whereon the scroll shaped portion 51 is not formed, the entire cavity 13 can be smoothly filled with the semimolten or semisolid metal, which prevents misruns, air inclusions, and cold shuts.

(2)

In addition, in the present embodiment, the aspect ratio of the passageway cross section of the runner 54, which is a passageway for filling the cavity 13 with the semimolten or semisolid metal, is t1:t2<1:3. Accordingly, the passageway of the runner 54 is not flat but rather has a somewhat square or circular cross sectional shape. Thereby, reducing the cross sectional length of the passageway of the runner 54 (in addition, the circumferential length of the pouring gate cross section) reduces cooling of the semimolten or semisolid metal at the runner 54 portion, which improves the fluidity of the melt. Consequently, the melt tends not to cool, which makes it possible to prevent misruns and improve yield.

In addition, because the cross sectional shape of the runner 54 is not flat but rather is somewhat square or circular, after the runner 54 is cut off of the molded scroll member 50, a lathe can be used to finish that cut portion of the molded scroll member 50, which makes it possible to reduce manufacturing costs.

(3)

In the present embodiment, the insert or slide mold 5, which is separate from the forming mold 2, is inserted between the cavity 13 and the runner 54, which is a passageway for filling the cavity 13 with the semimolten or semisolid metal, from a direction different from the directions in which the runner 54 extends, and subsequently the forming mold 2 is filled with the semimolten or semisolid metal.

Accordingly, because the insert or slide mold 5, which is separate from the forming mold 2, is inserted into the fixed mold 12, the runner 54 can extend to the center of the cavity 13 (in particular, to the end plate 52 portion), which effectively prevents the generation of a decarburized layer, oxide scaling, or the like. Moreover, after molding, the insert or slide mold 5 can be easily detached from the forming mold 2 without interfering with the runner 54.

Moreover, using the insert or slide mold 5 to supply melt from the boss 53 side makes it possible to shorten the cross sectional length of the pouring gate.

(4)

The scroll member 50 molded in the present embodiment is a movable scroll that comprises the columnar boss 53 that projects from the second surface 52*b*, which is on the opposite side of the end plate 52 to the first surface 52*a* wherefrom the scroll shaped portion 51 projects. Accordingly, in the molding method according to the present embodiment, the semimolten or semisolid metal fills the cavity 13 of the forming mold 2 of the scroll member 50 from the portion of the boss 53 and through the runner 54. Thus, filling the cavity 13 starting from the boss 53 of the scroll member 50 makes it possible to smoothly fill the entire cavity 13 (particularly the entire flat plate shaped groove 13*b* wherein the end plate 52 is formed)

with the semimolten or semisolid metal, which more effectively prevents molding failures and enables the manufacture of the scroll member 50 with high quality.

(5)

As mentioned above, in the present embodiment, reducing cooling of the semimolten or semisolid metal at the runner 54 portion further improves the fluidity of the melt; moreover, viewed from the direction in which the cavity 13 is filled, it is possible to fill the cavity 13 from the rear surface side of the center part of the scroll shaped portion 51 of the scroll member 50 toward the radial directions.

For these reasons, it is possible to eliminate misruns in the tip part of the scroll shaped portion 51 of the scroll member 50. In addition, it is possible to eliminate air inclusions as well as to prevent cold shuts.

Moreover, after the runner 54 and the material residuary part 55 are cut off from the molded scroll member 50, the scroll member 50 can be easily finished to its article shape using a lathe, which also makes it possible to reduce the cost of materials.

MODIFIED EXAMPLES (A)

Furthermore, the present embodiment explained an exemplary case of the scroll member 50 that comprises the scroll shaped portion 51, the end plate 52, and the boss 53, but the shape of the cavity 13 of the molding apparatus 1 may be suitably modified to form a fixed scroll or some other cast article.

(B)

Furthermore, in the present embodiment, to eliminate any scale from the surface of the semimolten or semisolid metal material C immediately after the semimolten or semisolid metal material C comes out of the material filling mechanism 6, the material filling mechanism 6 is disposed spaced apart from, but not immediately behind, the boss 53 by a distance commensurate with a dimension of the runner 54, but the present invention is not limited thereto.

As a modified example, the runner 54 may be omitted and the boss 53 may be filled directly and from immediately behind with semisolid metal material and the like. For example, in the case of semisolid molding or semimolten molding that is heated in a vacuum or a nitrogen atmosphere, hardly any oxide scaling is generated, and consequently there is no need for a contamination prevention measure for preventing contamination of the molded article. Therefore, there is no need for a scale trap, such as the material residuary part 55, and molding can be performed without the runner 54. Eliminating the need for the runner 54 consequently improves the yield of the scroll member 50. In addition, the mold configuration can also be simplified.

Industrial Applicability

The present invention can be adapted to a semimolten or semisolid molding method and a molding apparatus.

In addition, the present invention can also be adapted to the molding of a fixed scroll, a rotary front head, and the like.

What is claimed is:

1. A semimolten or semisolid molding method for casting a molded article with a semimolten or semisolid metal, the molded article including a flat plate portion and a projected portion that projects from one surface of the flat plate portion, the semimolten or semisolid molding method comprising:

filling a cavity with the semimolten or semisolid metal in plate thickness directions of the flat plate portion starting from an other surface on an opposite side of the flat plate portion from the one surface from which the projected portion projects, the cavity being a casting space of the molded article formed inside a firming mold;

the molded article including a columnar boss that projects in a projecting direction from the other surface on the opposite side of the flat plate portion from the one surface from which the projected portion projects, the projecting direction being perpendicular to the other surface; and the cavity of the forming mold of the molded article is filled with the semimolten or semisolid metal through a runner from the columnar boss portion, the runner being a passageway used to fill the cavity with the semimolten or semisolid metal, the runner having a longitudinal center extending in a direction transverse to the projecting direction, and the runner extending to the columnar boss portion along the other surface on the opposite side of the flat plate portion from the one surface from which the projected portion projects.

2. A semimolten or semisolid molding method according to claim 1, wherein an aspect ratio of a passageway cross section of a runner is less than 1:3, the runner being a passageway used to fill the cavity with the semimolten or semisolid metal.

3. A seminiolten or semisolid molding method according to claim 1, further comprising:

inserting an insert or slide mold between the cavity and a runner from a direction different from directions in which the runner extends, the insert or slide mold being separate from the forming mold, and the runner being a passageway used to fill the cavity with the semimolten or semisolid metal; and subsequently filling the forming mold with the semimolten or semisolid metal.

4. A semimolten or semisolid molding method according to claim 1, wherein the molded article is a scroll member, the scroll member including an end plate and a scroll shaped portion, the end plate forming the flat plate portion, and the scroll shaped portion forming the projected portion.

5. A semimolten or semisolid molding method according to claim 2, further comprising:

inserting an insert or slide mold between the cavity and the runner from a direction different from directions in which the runner extends, the insert or slide mold being separate from the forming mold; and subsequently filling the forming mold with the semimolten or semisolid metal.

6. A semimolten or semisolid molding method according to claim 5, wherein the molded article is a scroll member, the scroll member including an end plate and a scroll shaped portion, the end plate forming the flat plate portion, and the scroll shaped portion forming the projected portion.

7. A semimolten or semisolid molding method according to claim 2, wherein the molded article is a scroll member, the scroll member including an end plate and a scroll shaped portion, the end plate forming the flat plate portion, and the scroll shaped portion forming the projected portion.

8. A semimolten or semisolid molding method according to claim 3, wherein the molded article is a scroll member, the scroll member including an end plate and a scroll shaped portion, the end plate forming the flat plate portion, and the scroll shaped portion forming the projected portion.

9. A semimolten or semisolid molding method according to claim 1, wherein the runner extends from the columnar boss portion along the other surface beyond an outer periphery of a flat plate-shaped groove in which the flat plate portion is formed so that semimolten or semisolid metal is supplied to the runner at a location beyond the outer periphery of the flat plate-shaped groove.

10. A semimoiten or semisolid molding method according to claim 9, wherein the runner is spaced from the other surface along a direction perpendicular to the other surface.

* * * * *